United States Patent [19]

Oda

[11] 4,123,647

[45] Oct. 31, 1978

[54] THERMAL HEAD APPARATUS

[75] Inventor: Fujio Oda, Ashiya, Japan

[73] Assignee: Matsushita Electric Industrial Co., Ltd., Japan

[21] Appl. No.: 799,297

[22] Filed: May 23, 1977

[30] Foreign Application Priority Data

May 31, 1976 [JP] Japan ..... 51/63796
Aug. 18, 1976 [JP] Japan ..... 51/99132

[51] Int. Cl.[2] ..... H05B 1/00
[52] U.S. Cl. ..... 219/216; 346/76 R
[58] Field of Search ..... 219/216, 388 W, 543; 346/76 R

[56] References Cited

U.S. PATENT DOCUMENTS 3,476,877 11/1969 Perkins et al. ..... 346/76
3,609,294 9/1971 Cady, Jr. ..... 219/216

*Primary Examiner*—C. L. Albritton
*Attorney, Agent, or Firm*—Stevens, Davis, Miller & Mosher

[57] ABSTRACT

A thermal head apparatus is disclosed which comprises a heating resistor block provided with a plurality of heating resistors divided into plural groups, a diode array group provided with a plurality of diodes corresponding in number to the plurality of heating resistors, a conductor block provided with selective conductors for supplying selectively to the heating resistors, and a film carrier or the like provided with a plurality of conductors for connecting the heat resistors with the diodes and the diodes with the selective conductors. Thus, it is made possible as a result of forming each part in a block to make the apparatus compact and the manufacturing cost low.

3 Claims, 15 Drawing Figures

THERMAL HEAD APPARATUS

The present invention relates to an improvement in the constitution of a thermal head apparatus.

Figure 1:
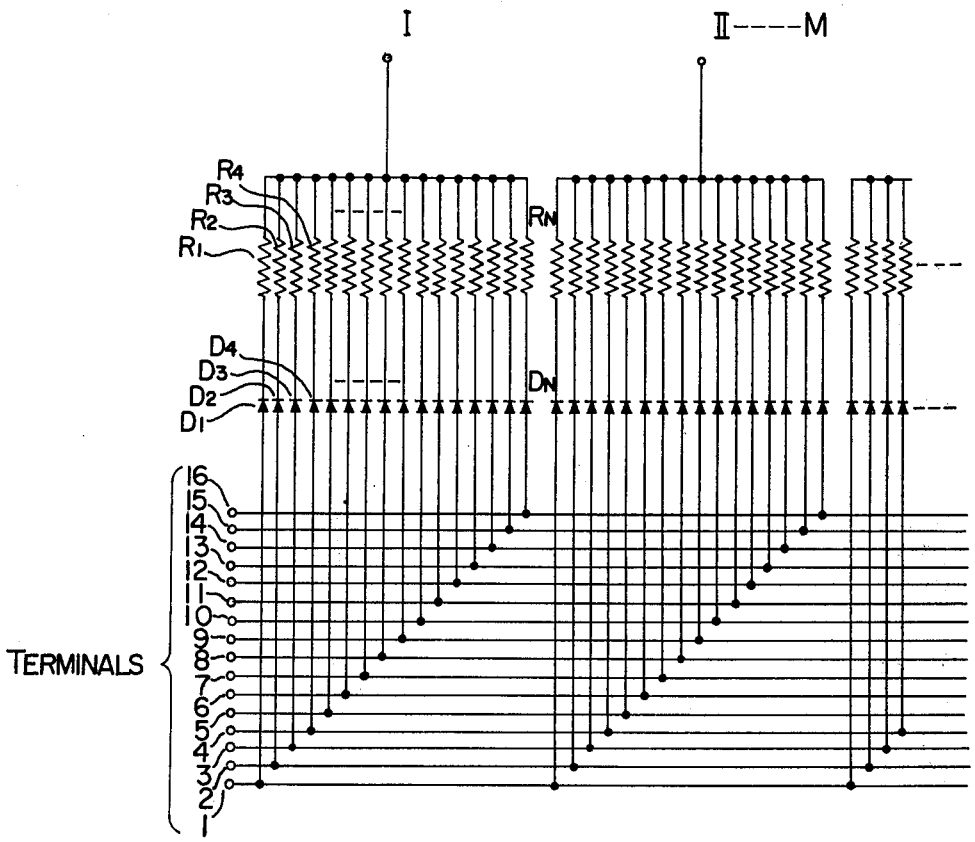
FIG. 1 PRIOR ART

In general, by the words "a thermal head recording apparatus" is meant an apparatus which includes a plurality of small heating resistors formed of heat-resistant material and arranged in a row or a matrix form so that particular resistors may be selectively supplied to color heat-sensitive recording sheets in contact with them for visualizing electric signals. When a thermal head is to be applied to a facsimile equipment, for example, it is necessary that a large number of heating elements be arranged in a row so that each of them may be electrically controlled. In such cases, in order to simplify the circuit constitution, the wiring shown in FIG. 1 is commonly used. In FIG. 1, the number N of the resistors belonging to each of the resistor groups, which are established for simplifying the external circuit, is determined to be any one of $N = 2^n$ ($n$ is an arbitrary integer) such as 8, 16, 32 or 64. By assembling M groups each having the N resistors, as shown in FIG. 1 for $N = 16$, the external circuit is made to have N driver circuits for heating resistors and thus it is possible to perform $M \times N$ matrix control by switching through M switching circuits. However, since the heating resistors do not have polarity, each of the resistors has to be provided with a diode $D_1$, $D_2$, . . . , or $D_N$ connected in series for preventing the flow of reverse current. Of course, this diode can be replaced by a transistor.

Moreover, it has become increasingly important that the resolution power of the heating element be large and a resolution power of at least 4 per mm has become necessary, that is, 4 heating elements per mm are required to be formed. Thus, though dependent on the width of the sheet to be printed, at least several hundred heating elements are usually required to be formed. Also, with respect to wiring, since the elements must be formed by photo-etching to assure the required accuracy, the head cannot be manufactured easily because its physical size must meet the width of the heat-sensitive recording sheet. Thus, although a thermal head is anticipated to be much in demand in the future due to its simple direct color developing characteristics, a great improvement from the manufacturing point of view is necessitated.

A thermal head according to the prior art consists, in general, of three parts, that is, an array of heating elements and the corresponding electrodes, an array of reverse current preventing diodes, and a multiple layer wiring part for making possible the matrix drive. When all these parts are intended to be formed on the same substrate for the purpose of making a compact form, some problems arise regarding the difficulty and the resulting yield rate in forming the elements and wiring work on the large substrate. On the other hand, when these parts are intended to be made individually, the above-mentioned problems may be solved to a substantial extent but other difficult problems can arise regarding the connection between the parts. After all, no optimum solution has been found at present.

The present invention intends to solve the above-mentioned problems and its primary object is to provide a thermal head which is compact in size, low in manufacturing cost and easy in mass production.

Another object of the present invention is to provide a thermal head which is very convenient for replacing parts in the case of trouble.

The above-described objects can be achieved by a thermal head apparatus comprising a heating resistor block provided with a plurality of heating resistors formed in several groups, a diode array group provided with a plurality of diodes corresponding in number to said plurality of heating resistors, a conductor block provided with selective conductors for supplying selectively to said heating resistors, and a film carrier or the like provided with a plurality of conductors for connecting said heating resistors with said diodes and said diodes with said selective conductors.

Figure 2:
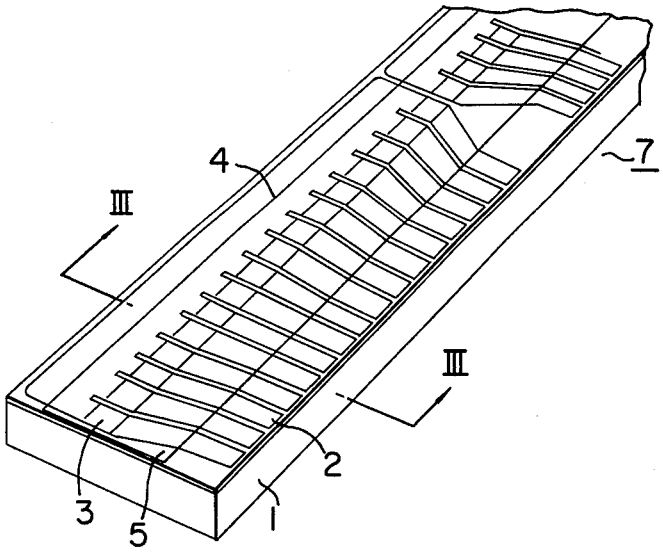
Figure 3:
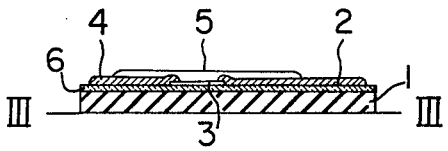
Figure 4:
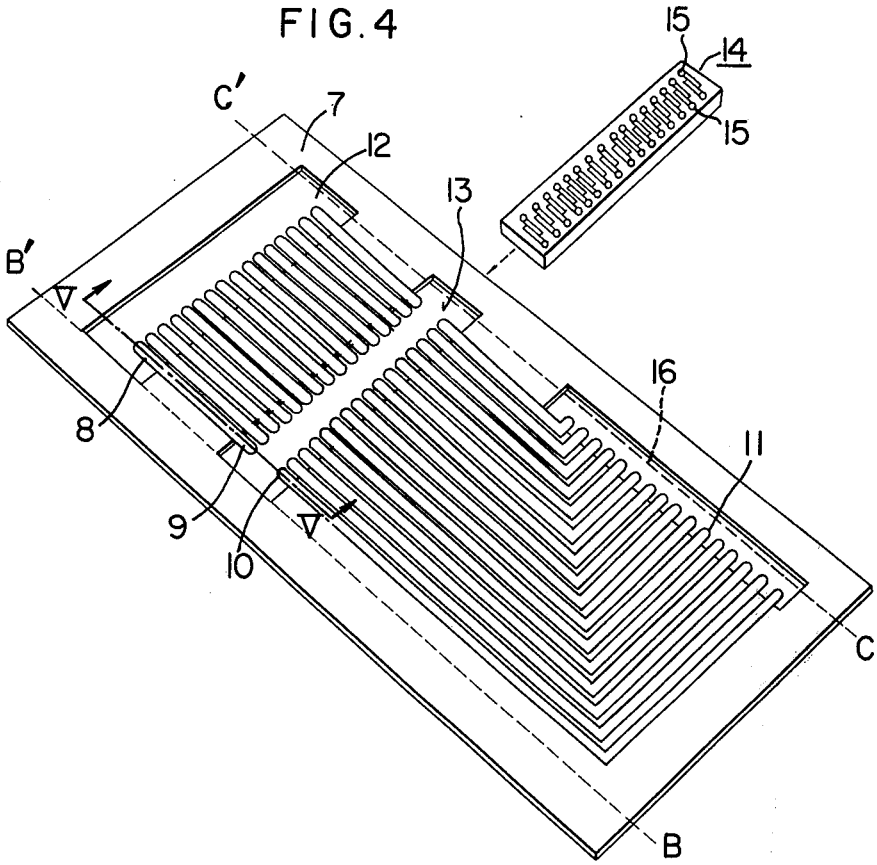
Figure 5:
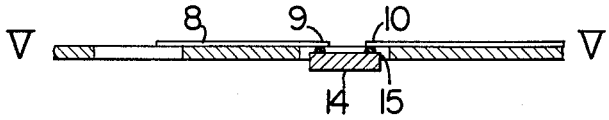
Figure 6:
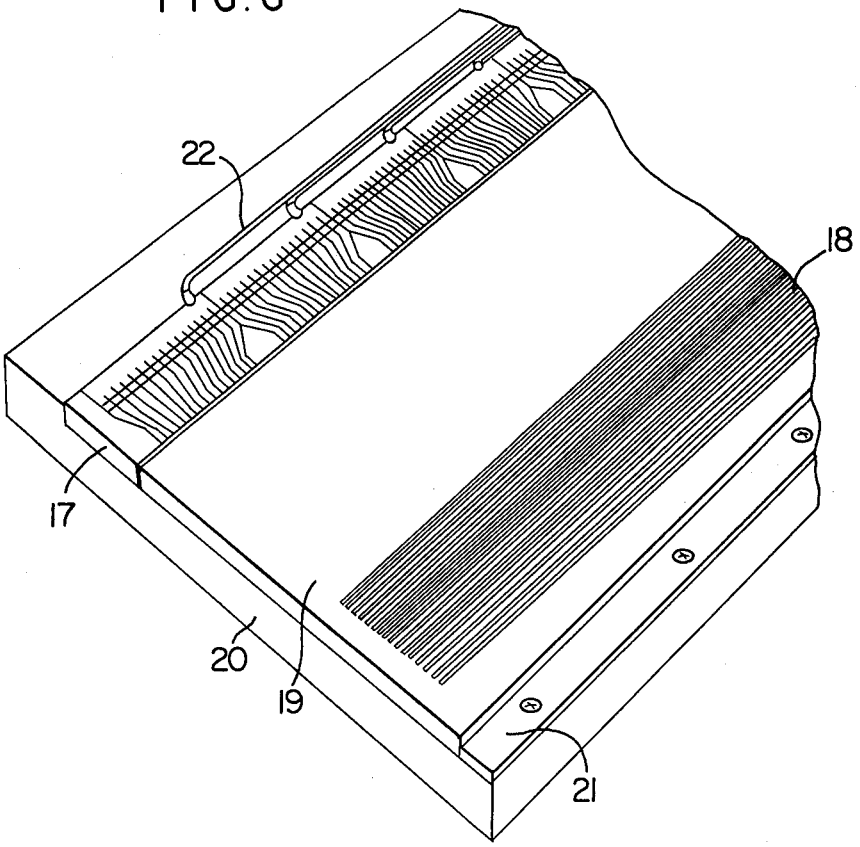
Figure 7:
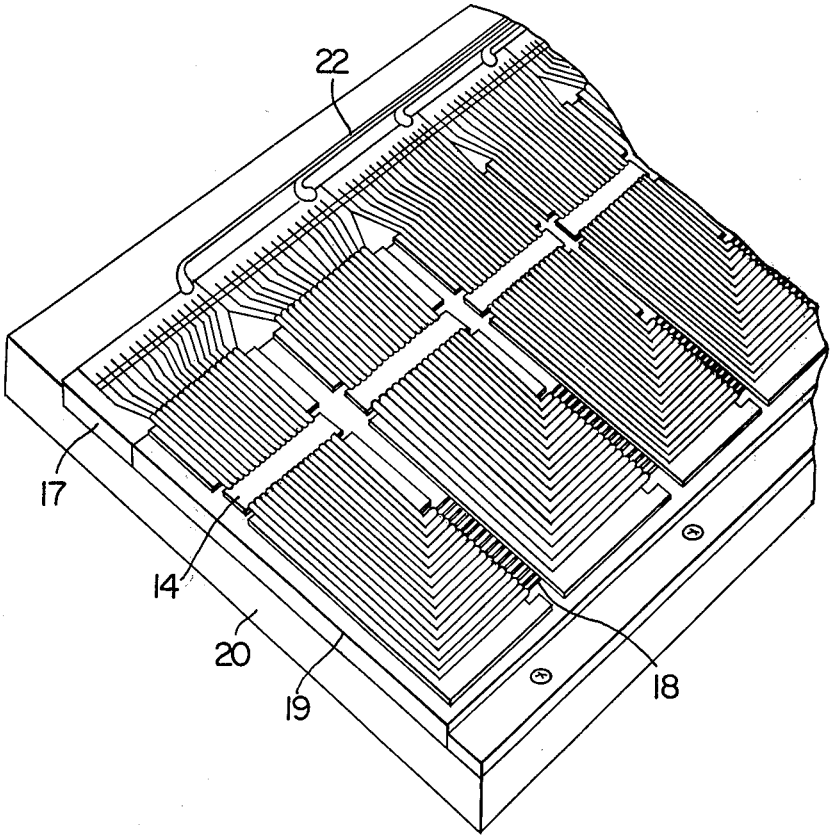
Figure 8:
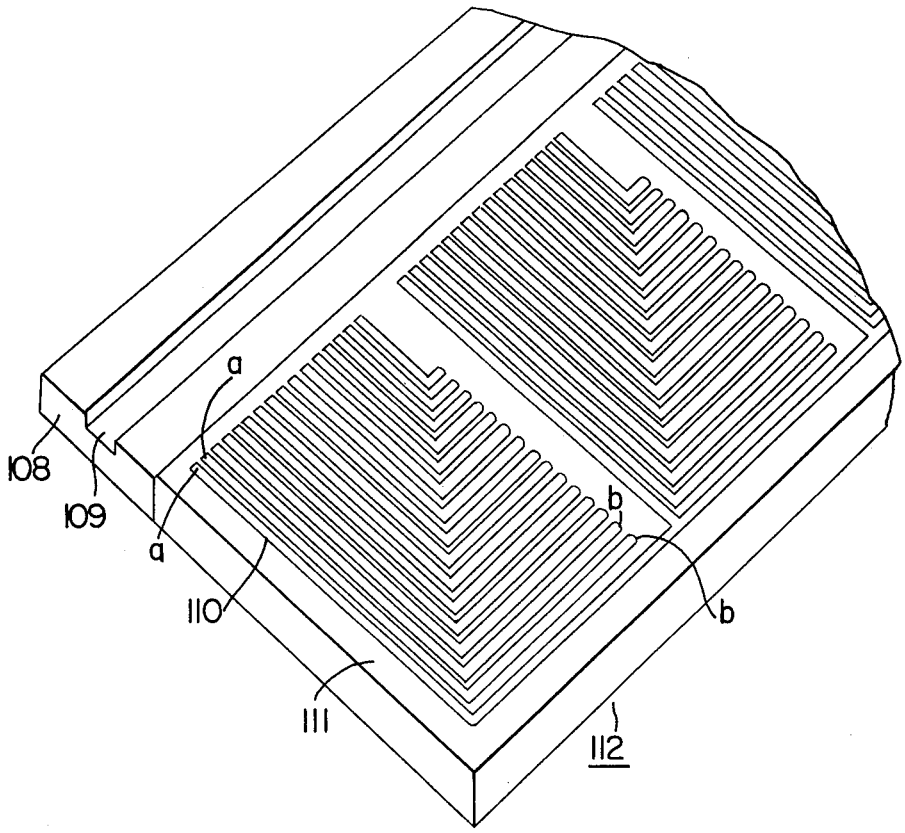
Figure 9:
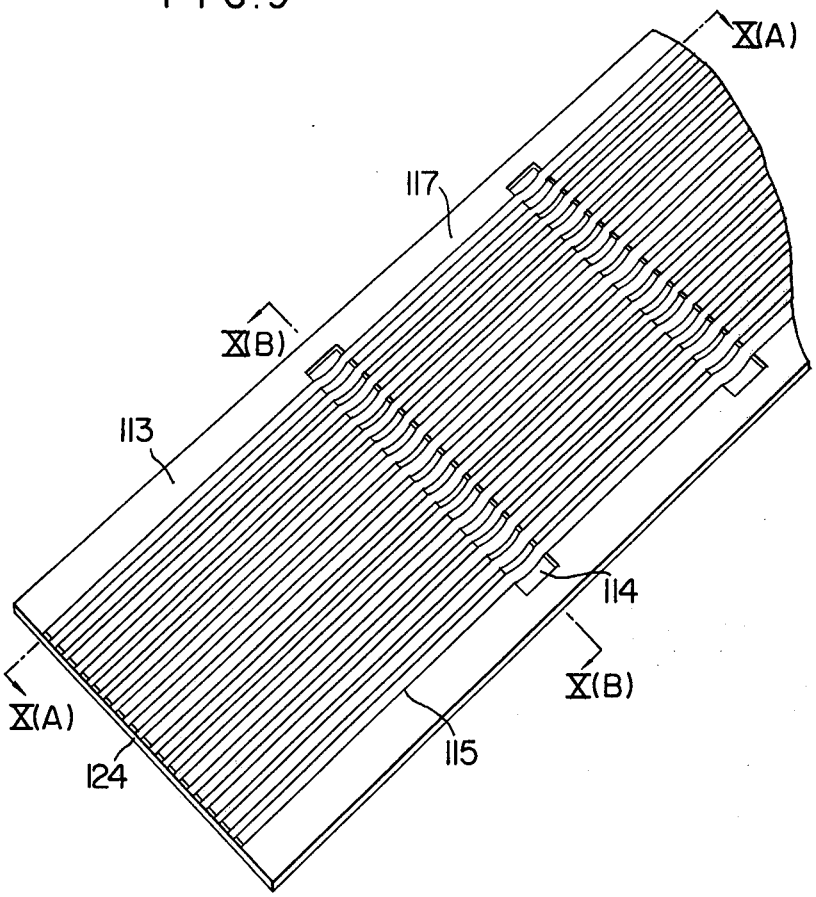
Figure 10:
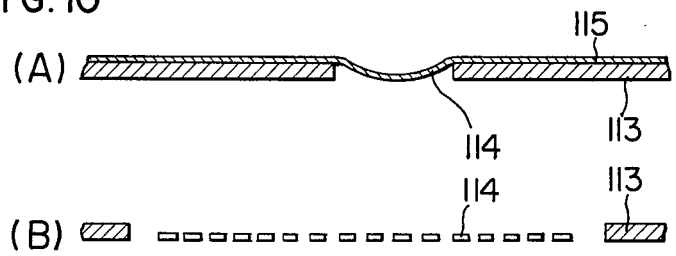
Figure 11:
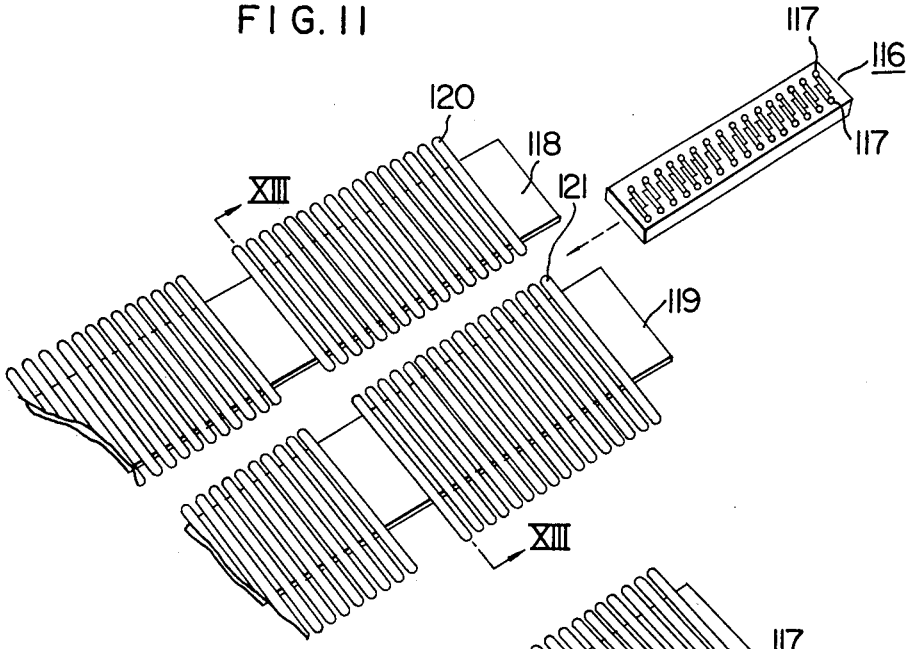
Figure 12:
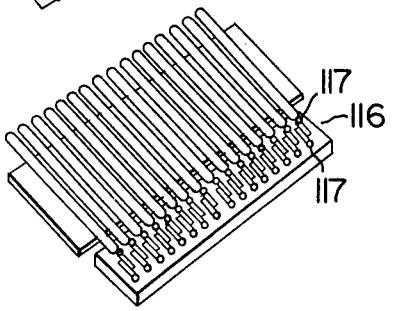
Figure 13:
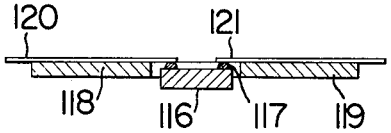
Figure 14:
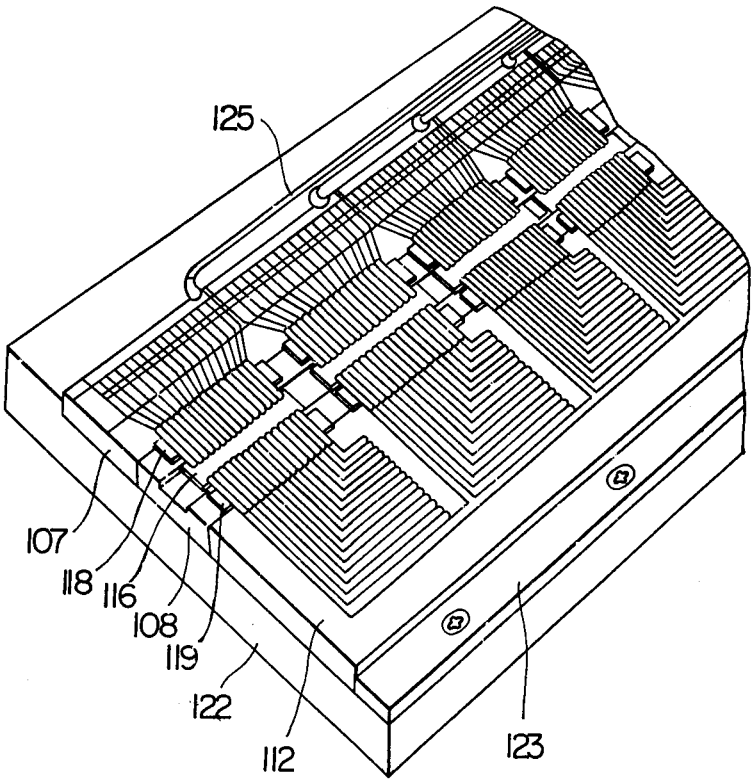
Figure 15:
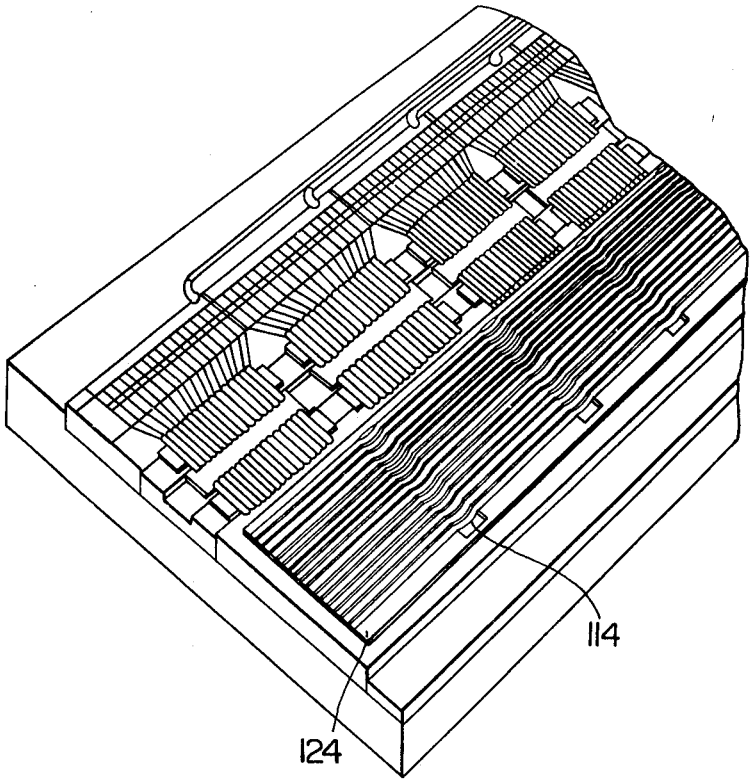

Other objects, features and advantages of the present invention will be readily apparent from the detailed description taken in conjunction with the accompanying drawings, in which:

FIG. 1 is a circuit diagram of a conventional thermal head of one array arrangement, FIG. 2 is a perspective of a heating element used in a thermal head according to the present invention, FIG. 3 is a cross-sectional view taken along the line III — III in FIG. 2, FIGS. 4 to 7 show an embodiment of a thermal head according to the present invention; in which, FIG. 4 is a perspective of an insulating sheet provided with a group of conductors, FIG. 5 is a cross-sectional view of a diode group mounted on the insulating sheet, FIG. 6 is a perspective of an insulating substrate having a heat-sensitive element portion mounted thereon, and FIG. 7 is a perspective of the insulating substrate shown in FIG. 6 further having the insulating sheet and the diode group mounted thereon, FIGS. 8 and 9 are perspectives of wiring substrates as constitutional elements of another embodiment of a thermal head apparatus according to the present invention, FIGS. 10(A) and 10(B) are cross-sectional views taken along the lines X(A) — X(A) and X(B) — X(B) in FIG. 9, respectively, FIG. 11 is a constitutional view of a diode array of another embodiment, FIG. 12 is a view showing the connecting portion between a film conductor and the diode array, FIG. 13 is a cross-sectional view taken along the line XIII — XIII in FIG. 11, and FIGS. 14 and 15 are a constitutional view during assembling and a finished view of another embodiment of a thermal head apparatus according to the present invention, respectively.

FIG. 2 shows the structure of a heating resistor array block used in a thermal head according to the present invention. In FIG. 2, numeral 1 is a heat-resistant substrate which is of such mechanical strength and insulating character as ceramic and may be provided with a glass layer 6 for smoothing the surface and for thermal insulation. Numeral 3 shows heating resistors which are formed just as dots in a row nearly centrally on a rectangular substrate and each of which is formed, by means of vacuum evaporation, sputtering or the like as a resistor layer of nichrome, silicon having a high impurity concentration, carbide, silicate or nitride. Numerals 4 and 2 are electrode terminals for the resistors which are formed of nickel, gold, aluminum or the like. The electrode terminals 2 are individual separate electrodes while each of the electrode terminals 4 is common to every N electrode terminals 2 with N being a particular integer. Numeral 5 is a wear-resistant layer which serves to prevent wear resulting from the element contacting a recording sheet and is formed of silicon carbide, nitride, oxide or the like having a thickness of several microns. Such rows of heating elements can be made advantageously in large numbers from a large-sized plate. Further, each of the separate terminals 2 is made narrower and narrower toward its end for facilitating the connection with a hereinafter-described film lead. FIG. 3 is a cross-sectional view taken along the line III — III in FIG. 2.

FIGS. 4 and 5 show the wiring which is essential to the present invention. The wiring for the N heating elements is formed in such a manner that a copper thin sheet mounted on a heat-resistant, flexible and insulating film 7 (usually polyimide organic film) in FIG. 4 is subjected to photo-etching to provide conductor line portions called fingers 8, 9 and 10 the surfaces of which are further plated with tin, solder or the like. Further, for the hereinafter-described reason, the film 7 is made to have openings 12, 13 and 16 so that the fingers 8, 9 and 10 are exposed at their ends. Next, a diode group 14 having N diodes therein as shown in FIG. 4 is inserted into the opening 13 so that the conductors may be aligned at their end portions called fingers with the electrode projections or bumps formed on the diode terminals of the diode group respectively in one to one correspondence and the diode group 14 may be connected with the intermediate portion of the wiring by means of heat and pressure applied to the fingers. FIG. 5 is a cross-sectional view taken along the line V—V in FIG. 4 when the diode group 14 is mounted. The film perforations 11, 12 and 13 are adapted to receive the electrode portions and the fingers 9 and 10 are shown to be connected through the bumps 15 with the diode group 14.

In FIG. 6, a heating element substrate 17 and an insulating substrate 19 having N parallel conductors 18 are mounted fixedly through a metallic member 21 on a metallic substrate 20. Numeral 22 shows a common terminal wiring for N heating elements and M such terminal wirings in all are required. Further, though not shown in detail in FIG. 6, there are provided in practice spaces between the heating elements as shown in FIG. 4.

FIG. 7 shows an embodiment in its assembled form according to the present invention, in which a unit having the film leads as shown in FIGS. 4 and 5 and the diodes connected with the former is mounted on the substrate 19 in FIG. 6. The film shown in FIG. 7 is provided by cutting that shown in FIG. 4 along the lines BB′ and CC′ so as to remove its excessive portions. The fingers 8 in FIG. 4 are mounted on the electrode terminals 2 by heating and pressing so as to serve as separate terminals for the heating resistors. Also, through the conductors 18 in FIGS. 6 and 7, the fingers 8 in FIG. 4 are connected with the common wiring portion on the substrate 19 by heating and pressing. These film units are mounted on the mounting substrate 3 by a number corresponding to M so that as a whole a matrix M × N may be formed. Further, though not shown in detail in FIG. 7, there are provided in practice spaces between the heating elements and between conductor lines.

FIGS. 8 and 9 are perspectives of a conductor line block 112 and a conductor line forming film 117, respectively, showing the wiring constituting the matrix as a constitutional element of another embodiment of a thermal head apparatus according to the present invention. In FIG. 8, a substrate 111 is formed of an insulating material of little deformation, on which is formed conductor lines 110 in such manner that every N lines, for example, N = 16 as shown in FIG. 8, are formed into a group and M such groups are repeated. One ends *a* of the conductor lines 110 are arranged in parallel with each other so as to be connected with the electrode terminals 2 as will be described later while the other ends *b* are arranged in such manner that the array of the ends *b* is perpendicular to the array of the ends *a*. Since a high degree of accuracy is required for such wiring work, usually the substrate 111 is evaporated over its entire surface with high conductivity material such as chorme, copper, nickel, silver or gold in a single layer or multiple combined layers and this is photoetched. A substrate 108 is provided for mounting directional semiconductor elements to be described later and also for keeping constant the spacing between the heating resistor array block 107 and the conductor line block 112. The substrate 108 is provided with a shallow groove portion 109 for facilitating the reception of semiconductor elements. The heating resistor array block shown in FIG. 2 is not manufactured one at a time but in numbers by evaporating and photo-etching the same patterns on a substrate having a considerably wide area and then by cutting it into rectangular pieces. FIG. 9 shows a conductor portion for connecting commonly the groups of the terminals *b*, which has a flexible insulating film 113 and a group of N narrow conductors 115 formed on the film 113. This group of N conductors has a pitch such that the N conductors are in register with the ends *b* in FIG. 8 and the film 113 has an opening 114 such that the conductors may be exposed through the opening 114 to be connected electrically and mechanically with the ends *b* of the conductors in FIG. 8. FIGS. 10A and **10*b* show cross-sectional views taken along the lines X(A) — X(A) and X(B) — X(B) of the conductor line film 124. The conductor film 124 is laid over the conductor line block 112 in such manner that the conductor lines across the opening 114** are in contact with the ends *b* of the conductor lines 110 of the conductor line block 112.

FIG. 11 exemplifies a connection process of the directional semiconductor elements which are to be inserted into every group of the conductor lines. The diode group 116 comprises N separate diodes formed on the same substrate. Numeral 117 is the bump terminal of each diode. Heat-resistant long films 118 and 119 of polyimide, for example, are provided with arrays 120 and 121 of conductor lines which are formed of copper foil by photo-etching and plating with gold, tin or the like and are projected outward on both sides. As shown in FIG. 12, the semiconductor elements can be connected at their respective one or both terminals at a time with the conductors 120 and 121 on the films 118 and 119 by means of, for example, heating and pressing the bump terminals 117 on the diode group 116 against the conductor end portions. FIG. 13 is a cross-sectional view taken along the line XIII—XIII in FIG. 11 when the conductor terminals are connected with the semiconductor elements on both sides. In this state, the elements are tested and then transferred to the final step of assembling the thermal head.

FIG. 14 shows the constitution in which the heating resistor block 107, the diode array group 116, the diode group mounting substrate 108, the film 118, 119 for supporting the conductor lines connected with the diode array, and the conductor lines block 112 are mounted on the same substrate 122 by adhesive or the like and fixed by a metal member 123. In this state, the diode group 116 is connected with the conductor lines on the films 118 and 119 provided on both sides of the groove in the substrate 108. Numeral 125 is a common terminal of the heating resistor block.

FIG. 15 shows the process of final assembly in which the end portions *b* of the conductor lines on the conductor line block 112 shown in FIG. 8 are commonly connected in every group by the conductor line film 124 shown in FIG. 9. The conductor lines across the opening 114 of the conductor line forming film 117 are connected with the end portions *b*.

Further, though not shown in detail in FIGS. 14 and 15, there are provided in practice spaces between the heating elements and between the conductor lines. Preferably, in the above-described constitution, the heating resistor block, the diode group supporting substrate provided with the connecting conductor lines, and the conductor line block are previously placed to be fixed and then the diode arrays are disposed in the groove of the substrate for every group of conductor lines in the conductor line block thereby to be electrically connected through the connecting conductor lines.

As described above, in the thermal head according to the present invention, since the conductors connected with the heating elements are divided into blocks for simplifying the external scanning circuit and the wiring is preformed for every block, the photoetching work is performed in an area several times smaller than the conventional one and thus the apparatus can be made compact advantageously from the manufacturing point of view. The directional semiconductor elements such as diodes or the like are divided into blocks for every group and are very convenient for replacement in the case of trouble. The conductors on the insulating sheet are projected at their ends and are convenient for connection. Since the heating elements are very small and the pitch error to the wiring in forming $M \times N$ heating elements can be eliminated by adjusting the shape of the insulating sheet unit, this makes manufacturing easy. When the whole length of the thermal head is intended to be changed (the number of the heating elements is intended to be changed), the change in the number of the insulating sheets suffices, that is, the change of the whole length can be made without substantial modification of the design. Further, since the high density wiring or the like is formed as units, repairing and inspection are very easy. Accordingly, in accordance with the present invention, there is provided a thermal head with a reduced overall manufacturing cost and an improved production efficiency.

What we claim is:

1. A thermal head apparatus comprising a support, a heating block having an electrically and thermally insulative substrate located on said support and a plurality of heating elements disposed on said electrically and thermally insulative substrate along a straight line, said plurality of heating elements being divided into a plurality of groups having a common connection for each group, a plurality of diode groups corresponding to said plurality of heating element groups, said plurality of diode groups including a plurality of diodes of identical polarity arranged along a straight line, an insulating substrate located on said support and having a group of conductors thereon for matrix-wiring said heating elements through said diode groups, and a film carrier provided with conductors for connecting said heating element block to the terminals on one side of said diode groups and the terminals on the other side of said diode groups to said group of conductors.

2. A thermal head apparatus as defined in claim 1, in which said film carrier is an insulating film which is common to said groups of heating elements and is provided with said conductors, said insulating film has openings at portions corresponding to said heating elements and said diode groups, said conductors are projected at their ends into said openings, said conductor substrate is arranged in parallel to the direction of the arrangement of said heating elements in such manner that said conductors being at least equal in number to said heating elements in respective groups of said heating elements are common to all said groups of said heating elements, and said conductors of said film carrier which are connected at respective one ends with said diode group are connected at the respective other ends with said in parallel arranged conductors.

3. A thermal head apparatus as defined in claim 1, in which said film carrier is used to connect between said groups of said heating elements and said diode groups and between said diode groups and respective one ends of the conductor groups on said conductor substrate, said conductor groups on said conductor substrate are equal in number to said heating element blocks and each of said conductor groups has conductors equal in number to the heating elements included in said heating element group, respective ends of said conductor groups which are connected with said diode groups are arranged in a direction crossing the direction of the array of said heating elements while the respective other ends of said conductor groups are arranged in parallel to the direction of the array of said heating elements, said conductor groups are provided independently of each other by the number equal to that of the heating element groups, said conductors in each of said groups being equal in number to the heating elements in said heating element groups and being arranged in parallel to each other, and said matrix-wiring film carrier which has openings at the portions corresponding to said respective other ends on said conductor substrate thereby to expose the conductors serves to connect commonly the conductors disposed at the same and corresponding positions in the respective conductor groups on said conductor substrate.

* * * * *